US006659839B2

(12) United States Patent
Iwasawa

(10) Patent No.: US 6,659,839 B2
(45) Date of Patent: Dec. 9, 2003

(54) MODEL AIRCRAFT CAPABLE OF REPRODUCING FLIGHT ATTITUDE

(75) Inventor: Tatsuo Iwasawa, Tokyo (JP)

(73) Assignee: Tokyo Marui Co., Ltd., Tokyo (JP)

( * ) Notice: Subject to any disclaimer, the term of this patent is extended or adjusted under 35 U.S.C. 154(b) by 0 days.

(21) Appl. No.: 10/139,249

(22) Filed: May 7, 2002

(65) Prior Publication Data

US 2003/0119417 A1 Jun. 26, 2003

(30) Foreign Application Priority Data

Dec. 25, 2001 (JP) ..... 2001-392600

(51) Int. Cl.[7] ..... A63H 27/00
(52) U.S. Cl. ..... 446/230; 446/232; 434/32
(58) Field of Search ..... 446/230, 232; 434/32

(56) References Cited

U.S. PATENT DOCUMENTS 1,973,592 A * 9/1934 Weisinger
2,219,658 A * 10/1940 Pasek
2,428,706 A * 10/1947 Hardell
3,204,952 A * 9/1965 Mitchell, Jr.
3,691,669 A * 9/1972 Folson et al.
3,762,702 A * 10/1973 Keele et al.
3,858,872 A * 1/1975 Summerfield et al.
3,864,873 A * 2/1975 Watkins
4,120,099 A * 10/1978 Fett
4,269,596 A * 5/1981 D'Andrade ..... 434/32
4,421,485 A * 12/1983 Geschwender ..... 434/32

FOREIGN PATENT DOCUMENTS

EP 108184 A1 * 5/1984

* cited by examiner

*Primary Examiner*—Derris H. Banks
*Assistant Examiner*—Ali Abdelwahed
(74) *Attorney, Agent, or Firm*—Jacobson Holman PLLC

(57) ABSTRACT

A toy or model aircraft with motions that can reproduce the operational status and flight attitude of the corresponding real aircraft. Model aircraft include a vertical motion device for enabling the aircraft body to ascend or descend in order to reproduce changes in position from a state in which the aircraft is set at a lower position so as to copy the attitude of the corresponding real aircraft during a halt on the ground to a state in which the aircraft is set at a higher position so as to copy the attitude of the corresponding real aircraft during a flight, and an attitude control device for enabling the aircraft body to be inclined in longitudinal and lateral directions in order to reproduce longitudinal and lateral motions of the rear aircraft, the attitude control device being provided at a tip portion of the vertical motion device, so that an operation performed by the vertical motion device can be synthesized with an operation performed by the attitude control device.

6 Claims, 13 Drawing Sheets

MODEL AIRCRAFT CAPABLE OF REPRODUCING FLIGHT ATTITUDE

DETAILED DESCRIPTION OF THE INVENTION

1. Field of the Invention

The present invention relates to toy or model aircraft that can reproduce the flight attitude of corresponding aircraft.

2. Description of the Prior Art

Some pieces of what is called toy aircraft have been known to include a rotatable propeller or to make a shooting sound of a strafe or sparks. However, these toys simply appear like corresponding real aircraft and can be converted into toy cars or animals by slight alterations. Accordingly, they are entirely different from toys or models having the characteristics of corresponding rear aircraft. In contrast, model aircraft produced by scaling down corresponding real aircraft is provided for show. Among such model aircrafts, solid models are considered to be best and are rather characterized by the absence of a movable part compared to simple toy aircraft.

Therefore, there have been few examples of toy or model aircraft which are quite different from simple toys and which are industrially mass-produced. Scale models made of plastics are industrially produced, and a large number of such products are commercially available. However, even if, for example, a motor can be integrated into such a model to allow a propeller to be rotated, this model still fails to sufficiently reproduce the operational status of rear aircraft.

SUMMARY OF THE INVENTION

The present invention is provided in view of these points, and it is an object thereof to provide motions that can reproduce the operational status or flight attitude of real aircraft. Another object of the present invention is to provide a toy or model having the characteristics of miniaturized aircraft with motions similar to those of corresponding real aircraft to allow a user to enjoy a sense of operation as is the case with a simulator.

These and other objects have been attained by the model aircraft according to the present invention comprising vertical motion means for enabling a model aircraft to ascend or descend in order to reproduce changes in position from a state in which the aircraft is set at a lower position so as to copy the attitude of a corresponding real aircraft during a halt on the ground to a state in which the aircraft is set at a higher position so as to copy the attitude of the corresponding real aircraft during a flight, and attitude control means for enabling the aircraft to be inclined in longitudinal and lateral directions in order to reproduce longitudinal and lateral motions of the aircraft. The attitude control means being provided at a tip portion of the vertical motion means, so that an operation performed by the vertical motion means can be synthesized by an operation performed by the attitude control means.

BRIEF DESCRIPTION OF THE DRAWINGS

FIG. 4(*b*) is an explanatory side view showing a descent of the aircraft;

FIG. 4(*c*) is an explanatory side view showing an ascent of the aircraft;

FIG. 5(*b*) is an explanatory front view showing a right turn of the aircraft;

FIG. 5(*c*) is an explanatory front view showing a left turn of the aircraft;

FIG. 6(*b*) shows a front view showing that the landing gears are down;

FIG. 7(*b*) is a front view showing that the left landing gear is up;

FIG. 8(*b*) is a front view showing that the right landing gear is up;

FIG. 9(*b*) is a front view showing that both landing gears are completely up;

FIG. 11(*b*) is an explanatory front view showing a right turn attitude;

DETAILED DESCRIPTION OF EMBODIMENTS OF THE INVENTION

Figure 1:
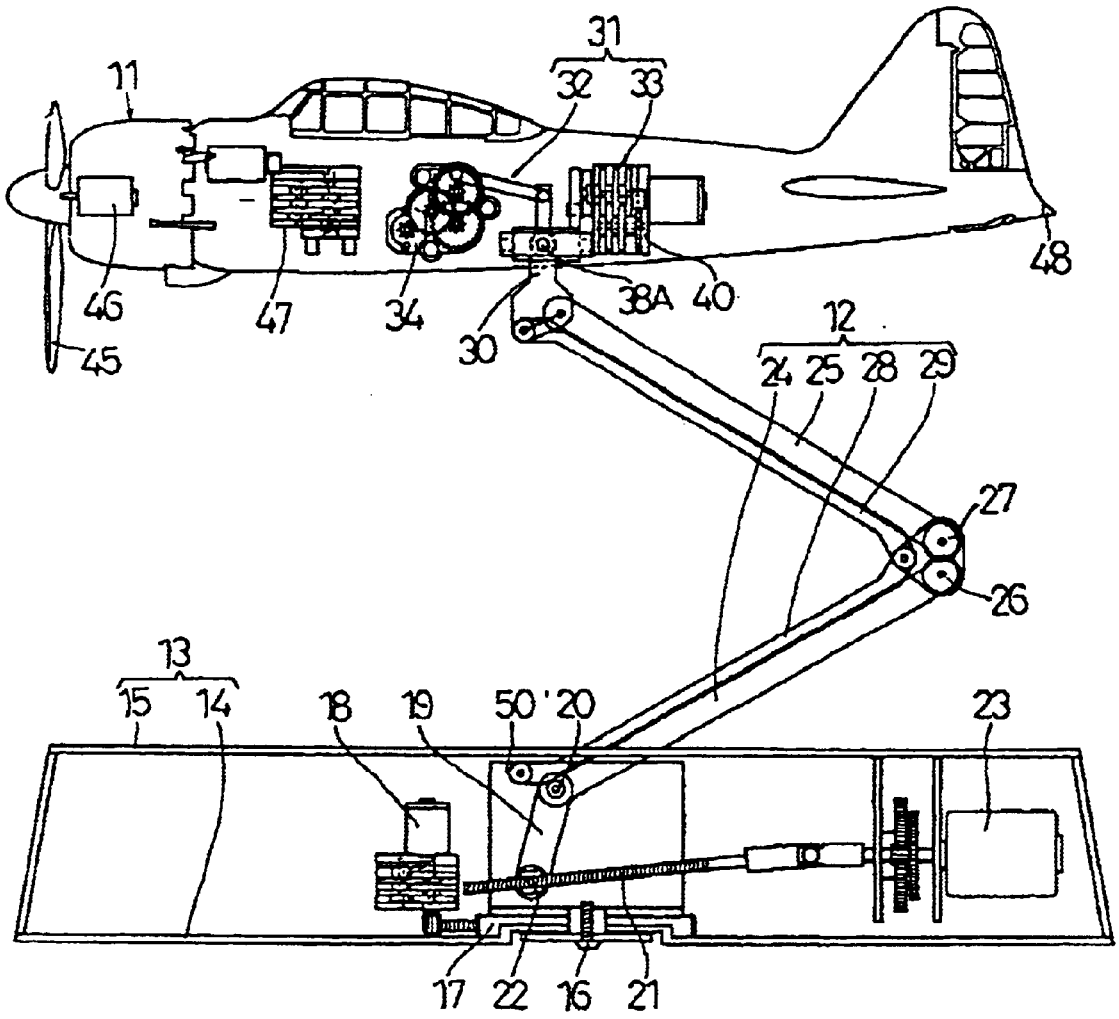
FIG. 1 is an explanatory side view showing the model aircraft capable of reproducing a flight attitude according to Embodiment 1 of the present invention.
Figure 2:
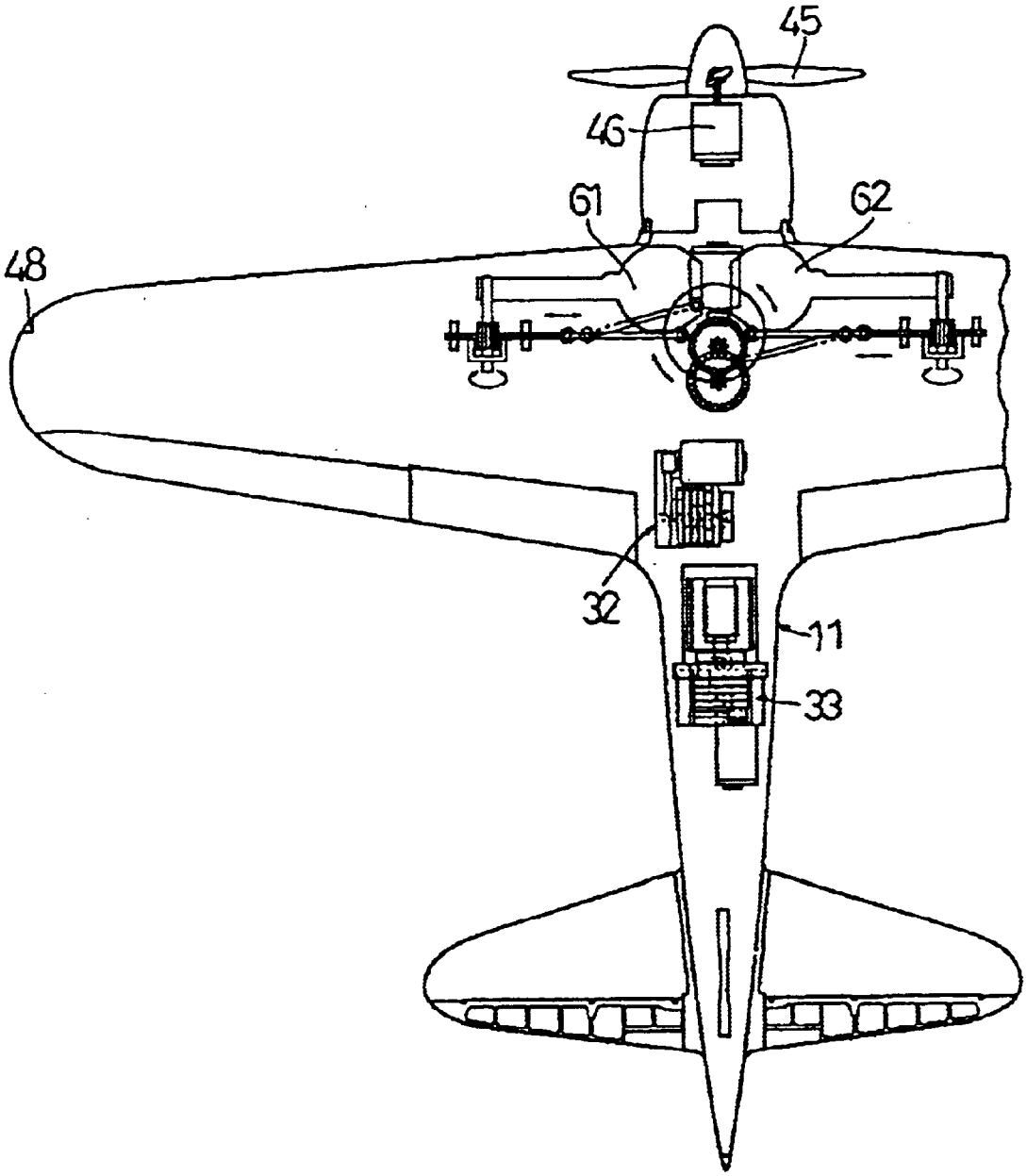
FIG. 2 is an explanatory plan view of Embodiment 1.
Figure 3:
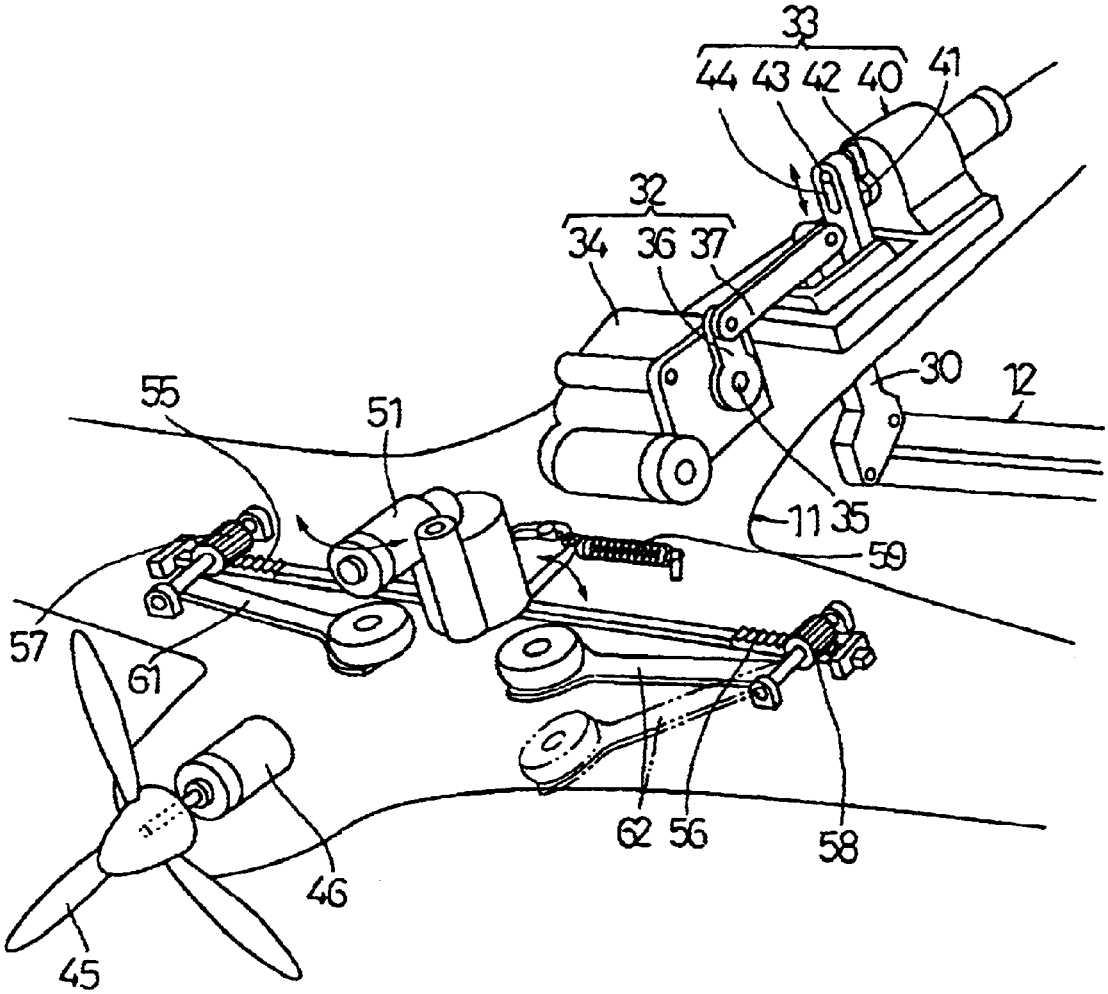
FIG. 3 is an explanatory perspective view showing operation mechanisms mounted in the model aircraft.

The model aircraft according to the present invention appears like a miniaturized aircraft whether or not the corresponding real aircraft exists, and is similar to toy aircraft in certain respects. The term aircraft, as used herein, refers to aerodyne or rotorcraft, a rocket, an airship, a balloon, or all structures or mechanical apparatuses that fly regardless of floating means they use, such as static buoyancy or aerodynamic lift. The model aircraft according to the present invention must be able to reproduce the flight attitude of the aircraft listed above.

To achieve this, the present model aircraft reproduces changes in position from a state in which a model aircraft is held in position so as to copy the attitude of a corresponding real aircraft during a halt on the ground to a state in which the aircraft is set at a higher position so as to copy the attitude of the corresponding real aircraft during a flight. For this purpose, vertical motion means is required which enable the aircraft to ascend or descend. The vertical motion means changes the position of the aircraft, i.e., higher or lower. The position of the aircraft on the ground and the position thereof during a flight are examples of such changes. However, if the attitude or form of the aircraft on the ground differs markedly from the attitude or form thereof during a flight, no problem occurs when setting the aircraft at a lower position so as to allow the ground attitude thereof to be reproduced.

The vertical motion means preferably has an expandable arm-like portion. It is not important what mechanism is used to make the arm-like portion expandable, any mechanisms or means can be employed. However, the most preferable mode is a foldable and movable mechanism, and a telescopic mechanism is to follow. The foldable and movable mechanism allows the height of the model aircraft to be easily and significantly changed and enables quick operations.

The present invention also requires attitude control means for enabling the model aircraft to be inclined in longitudinal and lateral directions. The longitudinal and lateral inclinations correspond to motions of the aircraft. That is, rotational motions in the longitudinal direction of the body axis correspond to pitching, whereas rotational motions in the lateral direction of the body axis correspond to rolling. These longitudinal and lateral motions of the aircraft allow the attitude of the aircraft to be substantially reproduced, but yawing around the perpendicular of the body axis may be added if required.

The attitude control means is provided at a tip portion of the vertical motion means so as to allow the model aircraft to reproduce an operation which is the synthesis of an operation performed by the vertical motion means with an operation performed by the attitude control means. As a result, the attitude of the aircraft during a flight is reproduced, that is, the attitude during taxiing on and taking off from the ground, an ascent, horizontal cruising, a lateral turn, a descent, landing, or vertical taking off or landing. The real aircraft requires lateral inclination in order to perform a motion to trigger a turn and thus change the flight direction. However, to reproduce this motion, it is possible to mount the vertical motion means on a support portion and to provide a rotating function for the support portion to cause a rotation in the turning direction simultaneously with an inclining motion of the aircraft.

The model aircraft of the present invention is provided with movable elements such as rotating portions such as propellers or rotors; retractable landing gears; or movable wings. Further, the model aircraft or its support portion may have sound generating means integrated therewith to reproduce sounds made during a flight of real aircraft. Further, lights can be easily turned on or off. All or some of these operating elements are operative.

Operations of the vertical motion means, attitude control means, operating elements, and sound generating means may be automatically controlled according to predetermined programs or may be externally manually controlled. Of course, the automatic control and the external manual control may be concurrently used. An automatic control section or external control section for operations is connected to one or all of the vertical motion means, attitude control means, movable elements, and sound generating means. The connection may be achieved using wired, wireless, or infrared communication lines, or other means.

The support portion has the vertical motion means mounted at one end thereof and may have the rotating function provided therein. It may also be used as a pedestal on which the model aircraft is held in its ground attitude. That is, the support portion can be used as a display pedestal and can further be used to install a speaker therein for sound generation.

In the present invention, the attitude control means can be provided at the tip portion of the vertical motion means. If the attitude control means is provided inside the model aircraft and the vertical motion means is formed like a stand arm, the model aircraft can be constructed so that the tip portion of the vertical motion means can be separated from the model aircraft including the attitude control means. This construction enables the model aircraft to be replaced with a different one, thereby allowing the model aircraft to be more easily manufactured. On the other hand, a certain model aircraft can be replaced with a different one so that the latter can be operated.

The present invention will be described below in detail with reference to an illustrated embodiment. FIG. 1 generally shows Embodiment 1 in which the present invention has been applied to a scale model of a single-engine and single-seat fighter with retractable landing gears used during World War II, as an example of fixed wing aircraft.

In FIG. 1, reference numeral 11 denotes an aircraft body of the model aircraft, and reference numeral 12 denotes vertical motion means for enabling the model aircraft to be moved in the vertical direction at a support portion 13. The support portion 13 is sized to hold the aircraft body 11 in its landing attitude, and is stable enough to withstand a change in gravity of the entire aircraft associated with a change in attitude of the aircraft body 11 during an ascent. The support portion 13 is composed of a base 14 and a rotating portion 15 that can be rotated relative to the base 14. The rotating portion 15 is fixed to the base 14 at the central shaft 16. Reference numeral 17 denotes a gear around the central shaft, and reference numeral 18 denotes a source of motion including a reduction gear set meshing with the gear 17 as well as a motor.

The lower end of the vertical motion means 12 is rotatably supported by a support shaft 20 in the support portion 13 so as to be movable in the vertical direction. The vertical motion means 12 includes an arm portion 19 extending further from the lower end thereof and having a mating screw 22 mating with a screw shaft 21 provided in the support portion so that the screw shaft 21 can be rotated to change the position of the vertical motion means relative to the support shaft 20 for vertical motions. Reference numeral 23 denotes a source of motion including a reduction gear set and a motor. The vertical motion means 12 is constructed in such a manner that lower and upper members 24 and 25 are supported at a position close to an articulated portion and that meshing portions 26 and 27 formed at ends of the lower and upper members mesh with each other so that the vertical motion means 12 can be bent at the articulated portion by changing the angle thereof at the articulated portion bend. The lower and upper members 24 and 25 are provided with lower and upper parallel members 28 and 29, respectively, to constitute a link mechanism that enables the lower and upper sets to move parallel with each other. The set of members 25 and 29 for upper parallel motions is provided with a tip portion 30 at the other end thereof.

Figure 4A:
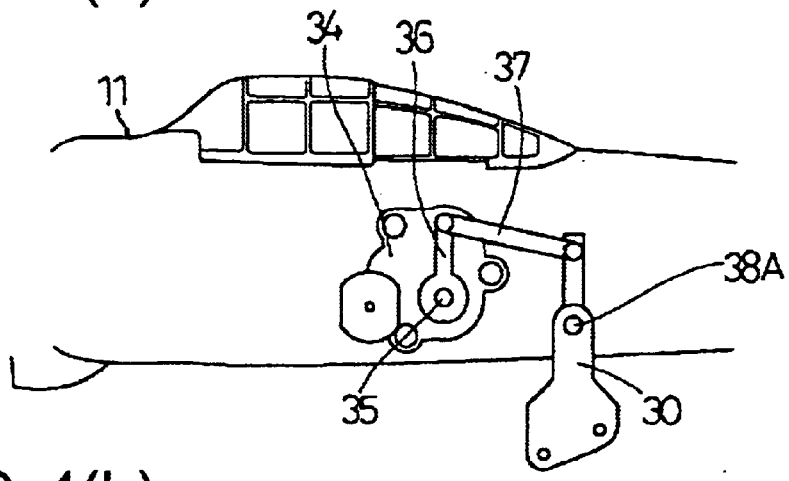
FIG. 4(*a*) is an explanatory side view showing a horizontal attitude of the model aircraft.
Figure 4B:
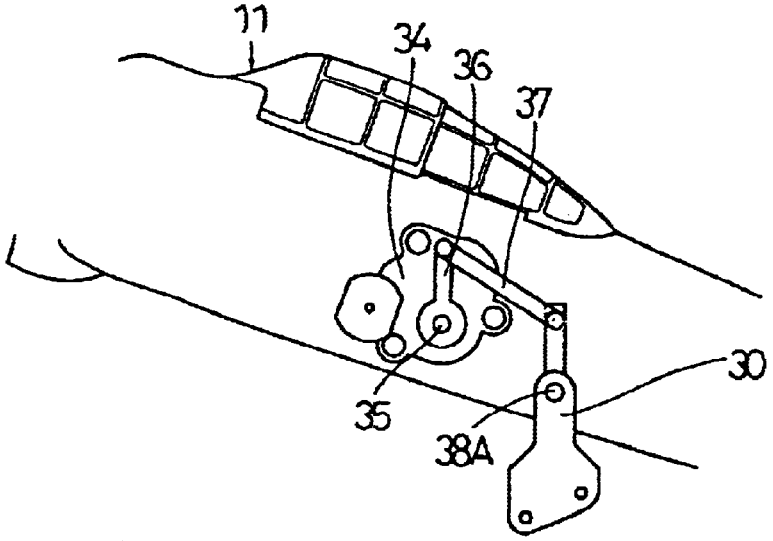
Figure 4C:
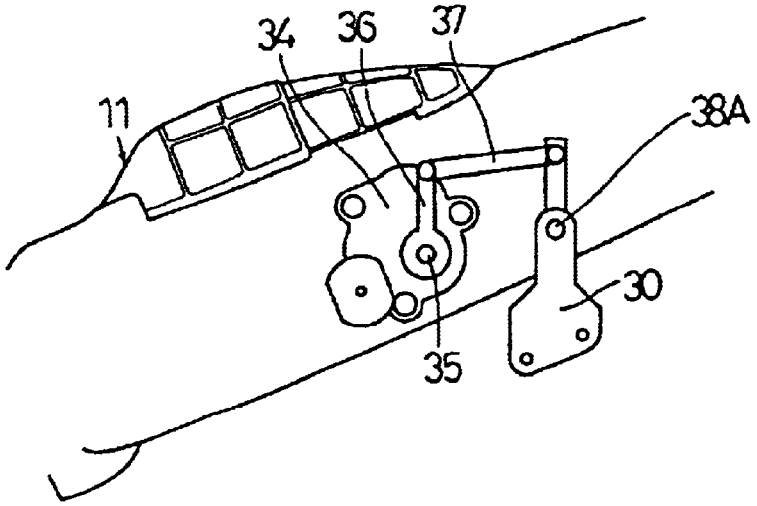
Figure 5A:
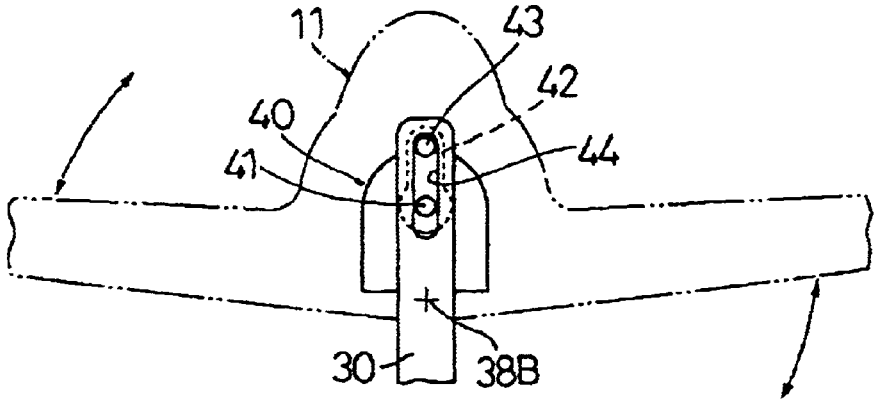
FIG. 5(*a*) is an explanatory front view showing a horizontal attitude of the aircraft.
Figure 5B:
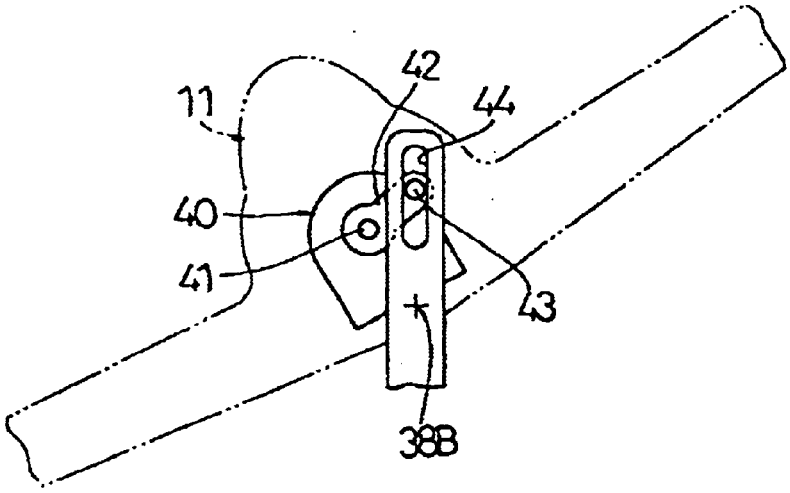
Figure 5C:
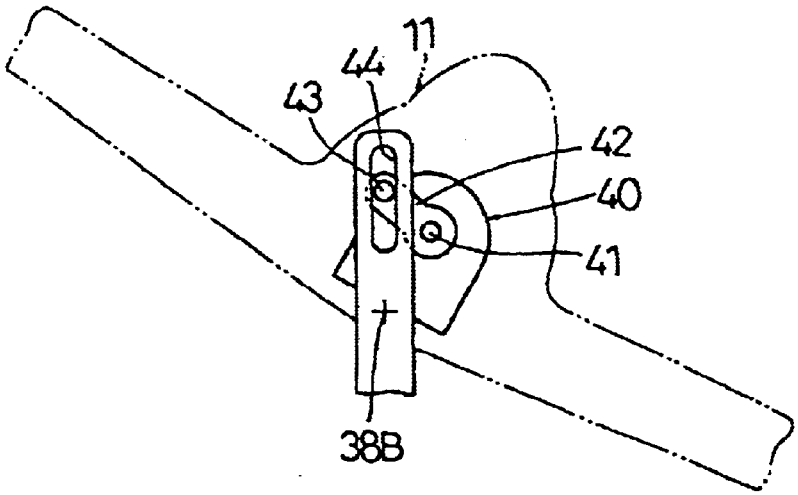

The tip portion 30 is linked to attitude control means 31 including a pitching mechanism 32 for vertical motions of the aircraft and a rolling mechanism 33 for lateral motions of the aircraft. The pitching mechanism 32 has a rotating shaft 35 of a source of motion 34 composed of a motor and a speed reducer, a rotating arm 36 attached to the rotating shaft 35, a linking member 37 that links the rotating arm 36 to the tip portion 30 of the vertical motion means 12, and a coupling shaft 38A that links the aircraft body 11 to the tip portion 30 of the vertical motion means 12 (see FIG. 4). The rolling mechanism 33 has a rotating arm 42 attached to a rotating shaft 41 of a source of motion 40 composed of a motor and a speed reducer, a pin 43 provided at the other end of the rotating arm 42, and a guide slot 44 formed at the tip portion 30 of the vertical motion means 12 and extending in the vertical direction so that rotation of the pin 43 is guided through the guide slot 44 to swing the aircraft body 11 around a coupling shaft 38B (FIG. 5). The coupling shafts 38A and 38B pass through the aircraft body 11 in the lateral and longitudinal directions, respectively.

The aircraft contains a rotating mechanism 46 for a propeller 45, a retractable landing gear mechanism 47, and a lighting device 48. The rotating mechanism 46 for the propeller 45 is linked with sound generating means for reproducing the roar of real aircraft corresponding to the present model aircraft. A speaker 50 is installed inside the support portion 13 as a part of the sound generating means.

The retractable landing gear mechanism 47 is shown in detail in FIGS. 6 to 9 together with examples of operations. The retractable landing gear 47 has a source of motion 51 composed of a motor with a speed reducer, a crank 52 integrated with the source of motion 51, links 53 and 54 extending laterally from the crank 52, racks 55 and 56 integrated with the links 53 and 54, respectively, and pinions 57 and 58 meshing with the racks 55 and 56, respectively. The pinions 57 and 58 are fixed to retractable rotting shafts of right and left wheels 61 and 62, respectively. This mechanism 47 has a time differential mechanism using spring means 59 in order to reproduce a system that retracts the right and left landing gears at different times as in some aircraft.

Figure 6A:
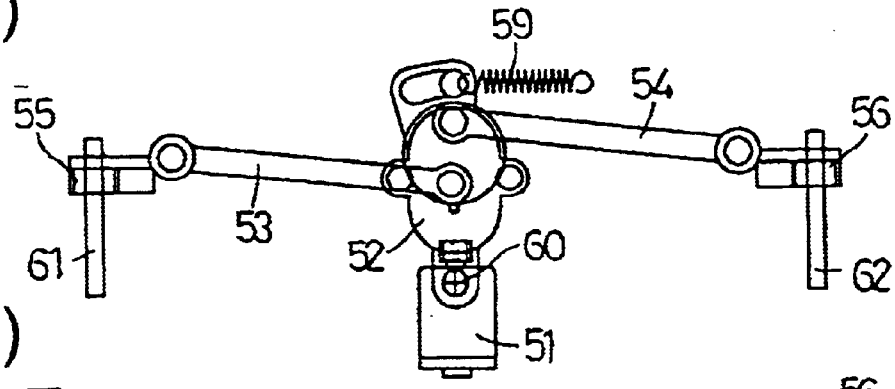
FIG. 6(*a*) is a plan view showing that landing gears are down.
Figure 6B:
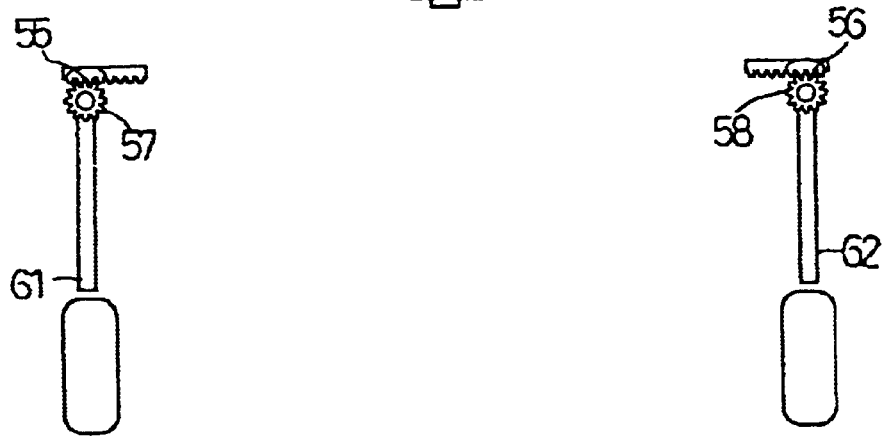
Figure 7A:
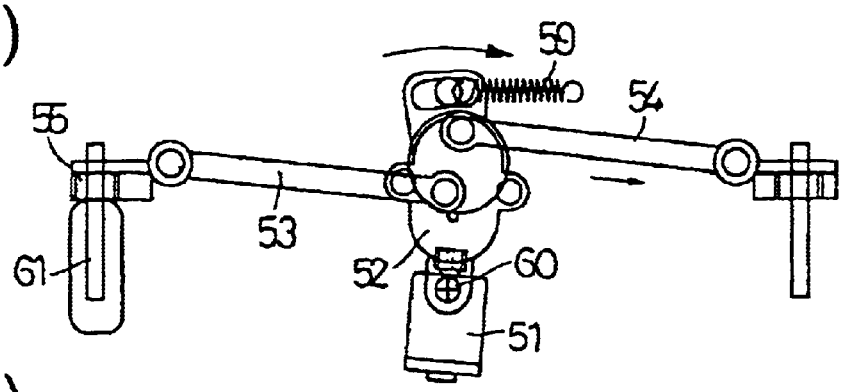
FIG. 7(*a*) is a plan view showing that the left landing gear is up.
Figure 7B:
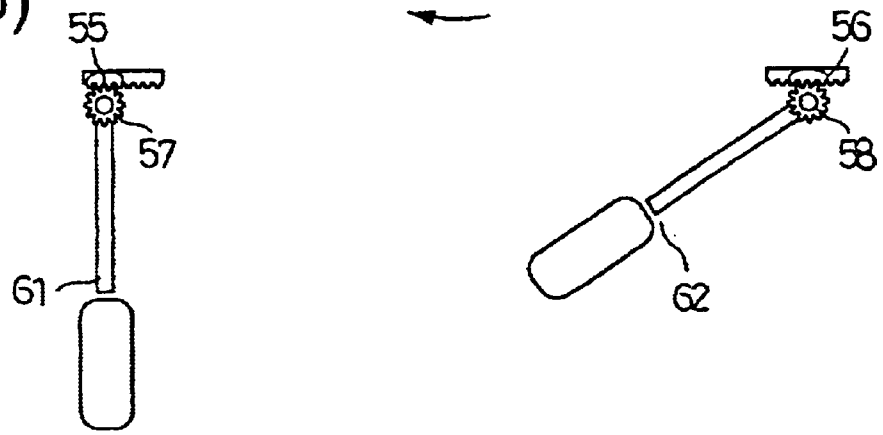
Figure 8A:
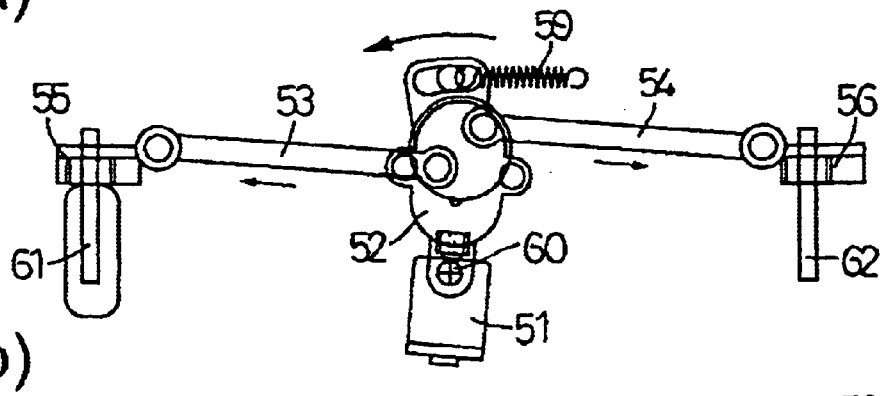
FIG. 8(*a*) is a plan view showing that the right landing gear is up.
Figure 8B:
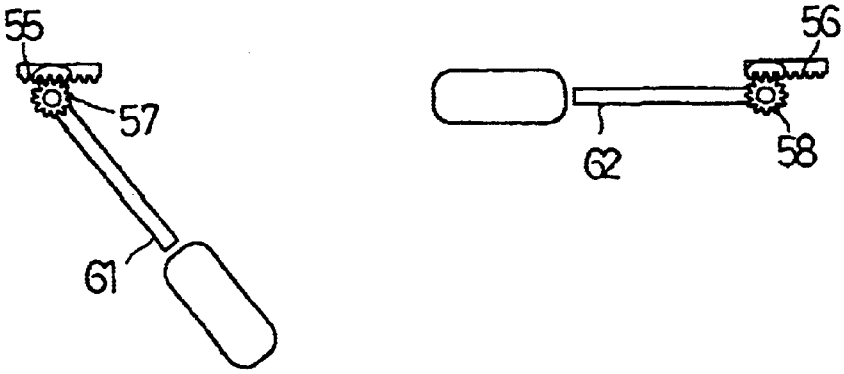
Figure 9A:
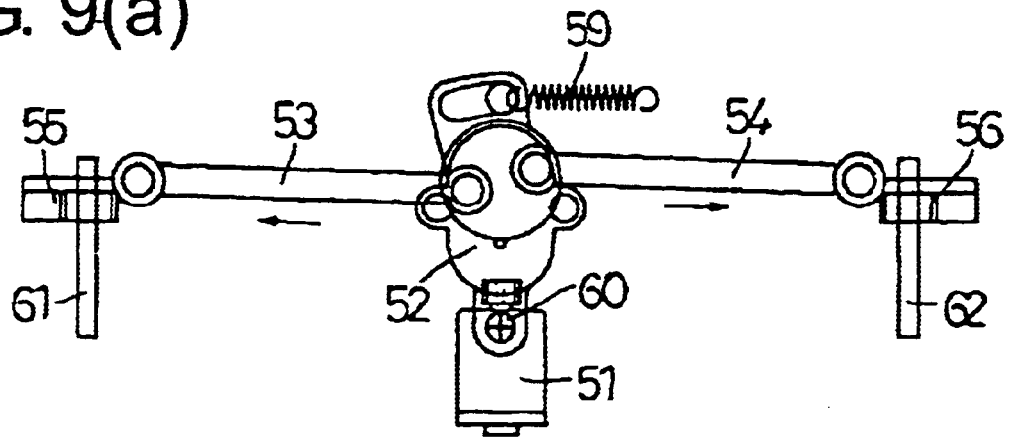
FIG. 9(*a*) is a plan view showing that both landing gears are completely up.
Figure 9B:
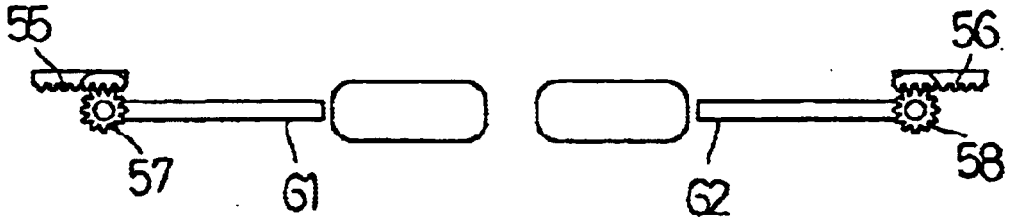

FIG. 6 shows that the landing gears are down and that no force is exerted on the right and left links 53 and 54. When the source of motion 51 is activated, the entire crank unit of the source of motion, is rotated rightward in FIG. 7(*a*) around an axis 60 thereof, and force is first applied to the link 54 to raise the right wheel 62 (FIG. 8). Then, the force that has been rotating the unit rightward is suppressed, so that the unit starts to rotate in the opposite direction to exert force that pushes the link 53, while the right link 54 is still being pushed. Finally, uniform force is exerted on the right and left links 53 and 54, arranged in a line, to completely retract the right and left landing gears (FIG. 9).

Figure 10:
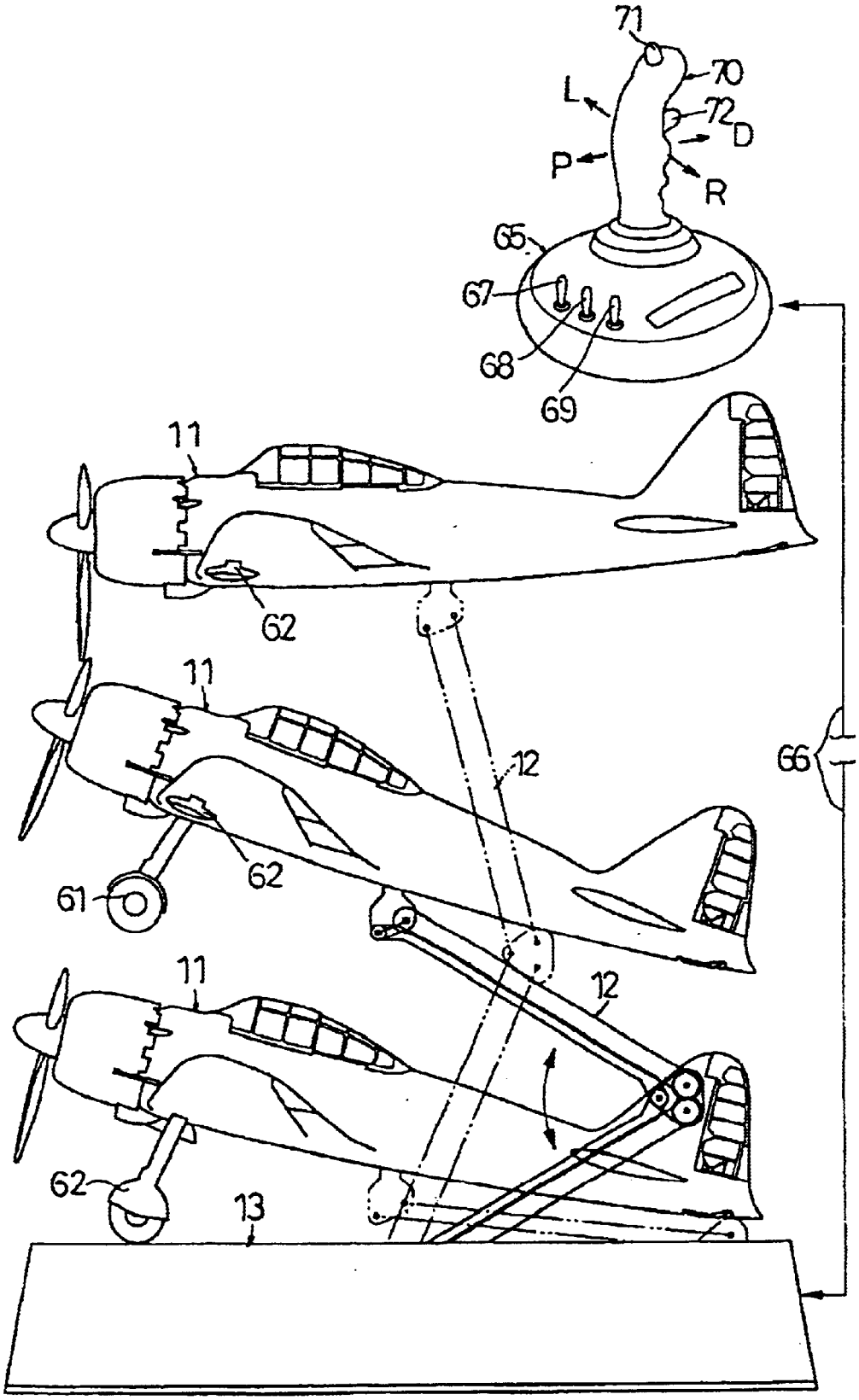
FIG. 10 is an explanatory side view showing an external control section and a change in flight attitude.

The operation of the above described model aircraft is controlled by a controller 65, shown in FIG. 10. The controller 65 is a wired external control section connect to control devices inside the support portion 13 and inside the aircraft body 11 via a wire 66. The controller 65 has a main switch 67 used both for a power supply and for lighting, a switch 68 used to rotate the propeller and to reproduce an associated roar, and a switch 69 used to raise and lower the retractable landing gears, as well as a stick-like operator 70 that can be pivoted forward and backward, and rightward and leftward so as to operate the attitude control means 31. The operator 70 is provided with a button 71 used for upward and downward motions and a strafe shooting button 72.

Figure 11A:
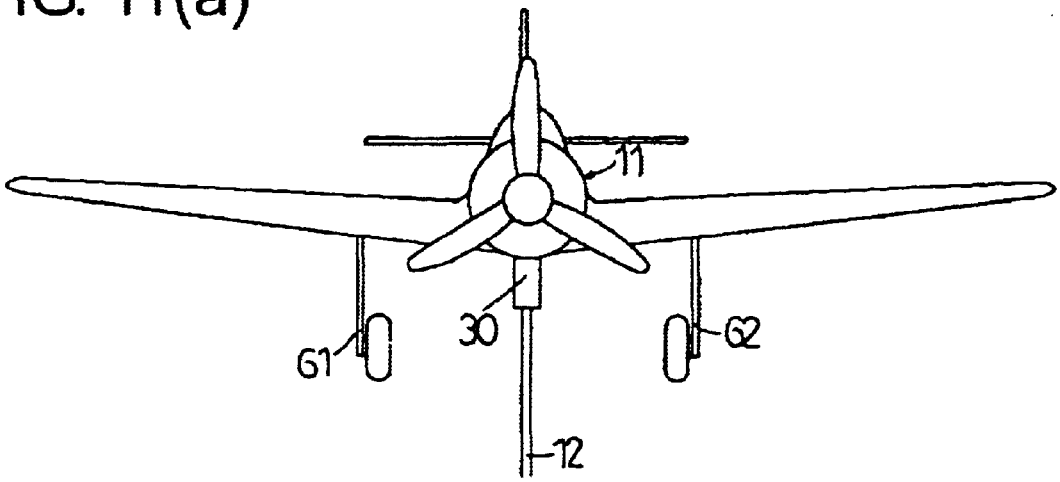
FIG. 11(*a*) is an explanatory front view showing a horizontal flight attitude.
Figure 11B:
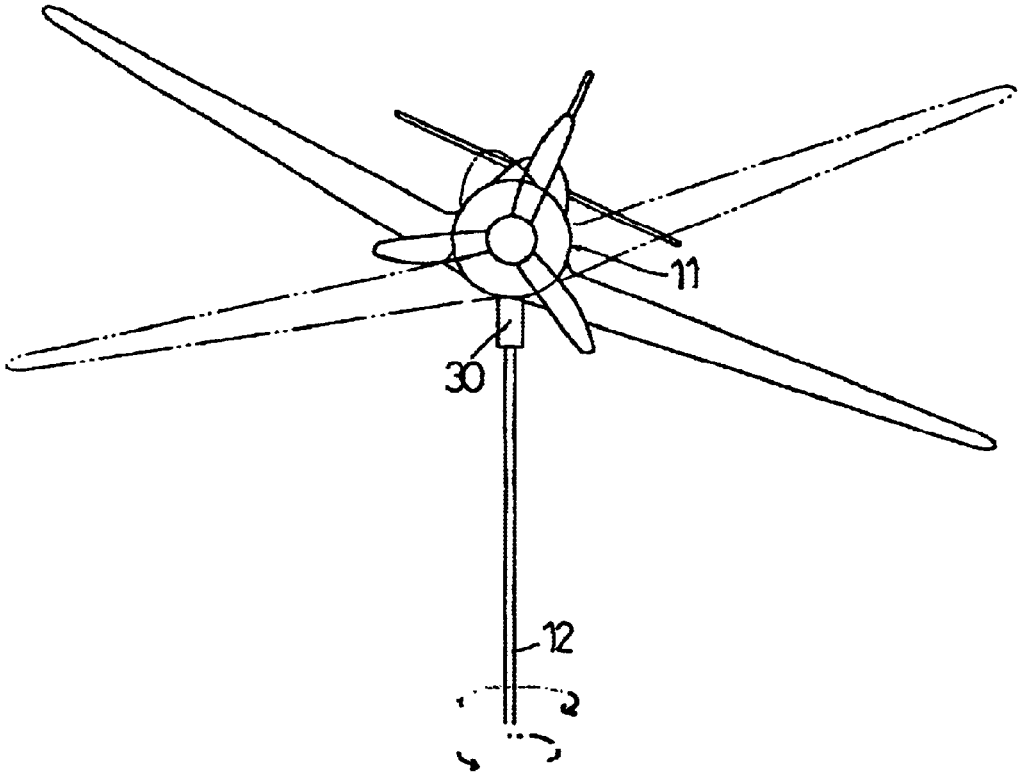

When the main switch 67 is turned on, a power supply circuit is switched on to blink a wing tip light of the lighting device, while lighting a tail light, indicating that the power supply is on. When the second switch 68 is turned on, the propeller 45 is rotated and a roar is provided by the speaker 50. The roar is desirably generated by a storage element having the sound of the engine of the corresponding real aircraft recorded thereon and contains an idling sound, an overload operation sound, a normal operation sound, and other sounds. When the stick-like operator 70 is held and the upward and downward motion operation button 71 is pulled downward, the aircraft body 11 is inclined as it is in the ascended attitude. On the other hand, when the upward and downward motion operation button 71 is pushed upward, the aircraft body 11 is inclined a it is in the descended attitude. An ascent and descent of the aircraft body 11 are shown in FIG. 10 at a top, middle, and bottom positions. Thus the operator 70 is pushed frontward (D), the aircraft body 11 assumes a descending attitude. On the other hand, when the operator 70 is pushed backward (P), the aircraft body 11 assumes an ascending attitude. During the ascent or descent, the landing gears can be up or down. Inclining the operator 70 leftward causes the aircraft body 11 to start turning leftward (L), while inclining the operator 70 rightward causes the aircraft body 11 to start turning rightward (R). Continuing to incline the operator leftward or rightward allows the rotating portion 15 to rotate in this direction. See FIGS. 11(*a*) and 11(*b*).

In this manner, the aircraft body 11 of the model aircraft of the present invention can be moved in the same manner as the corresponding real aircraft. That is, the aircraft body 11 can also function as a device that can simulate motions of the corresponding real aircraft. Furthermore, it can assume a flight attitude that cannot be assumed by the corresponding real aircraft, and is safe. Therefore, it can also be used as teaching material for flight performances.

Figure 12:
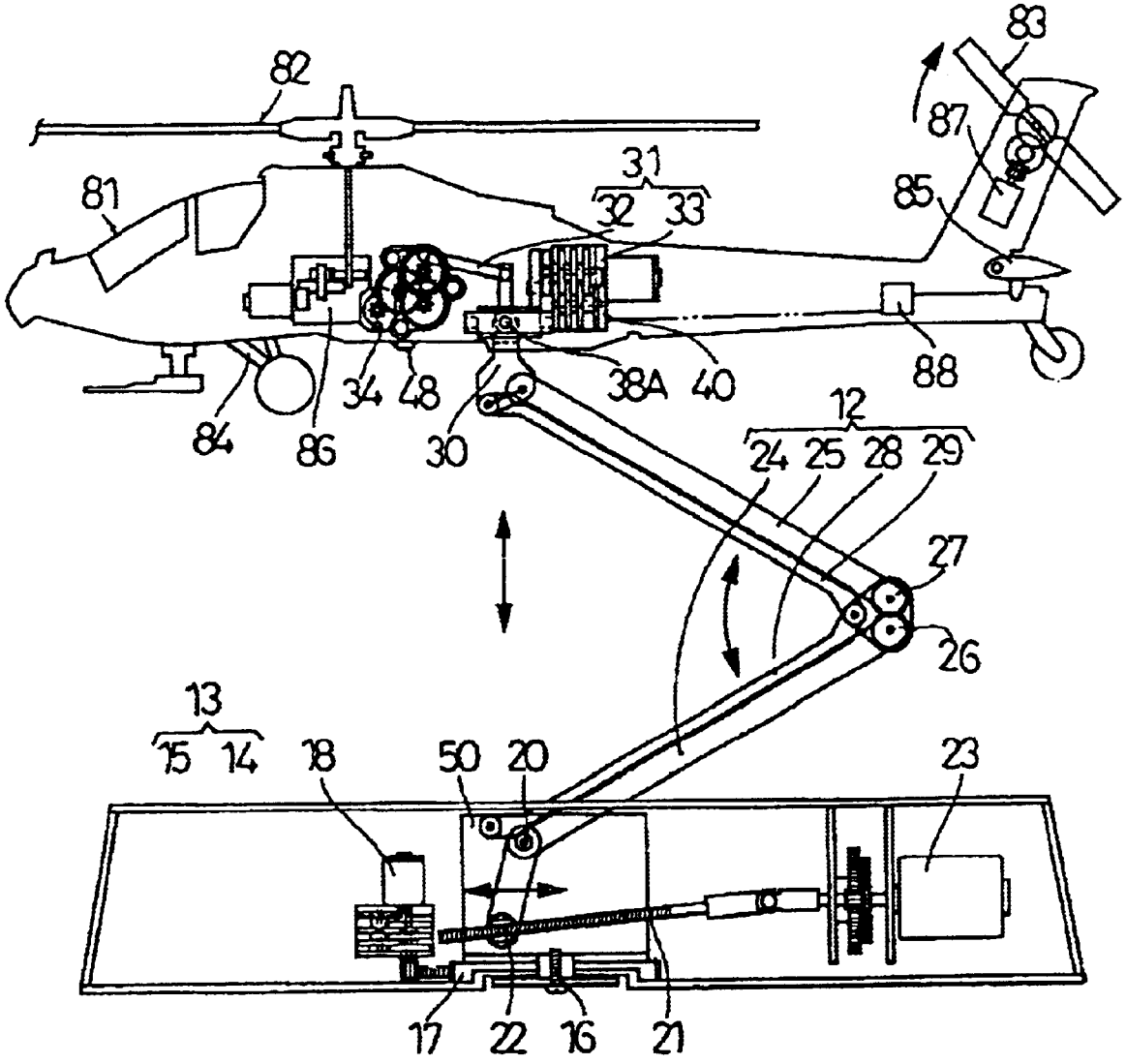
FIG. 12 is an explanatory side view showing the model aircraft according to Embodiment 2 of the present invention.
Figure 13:
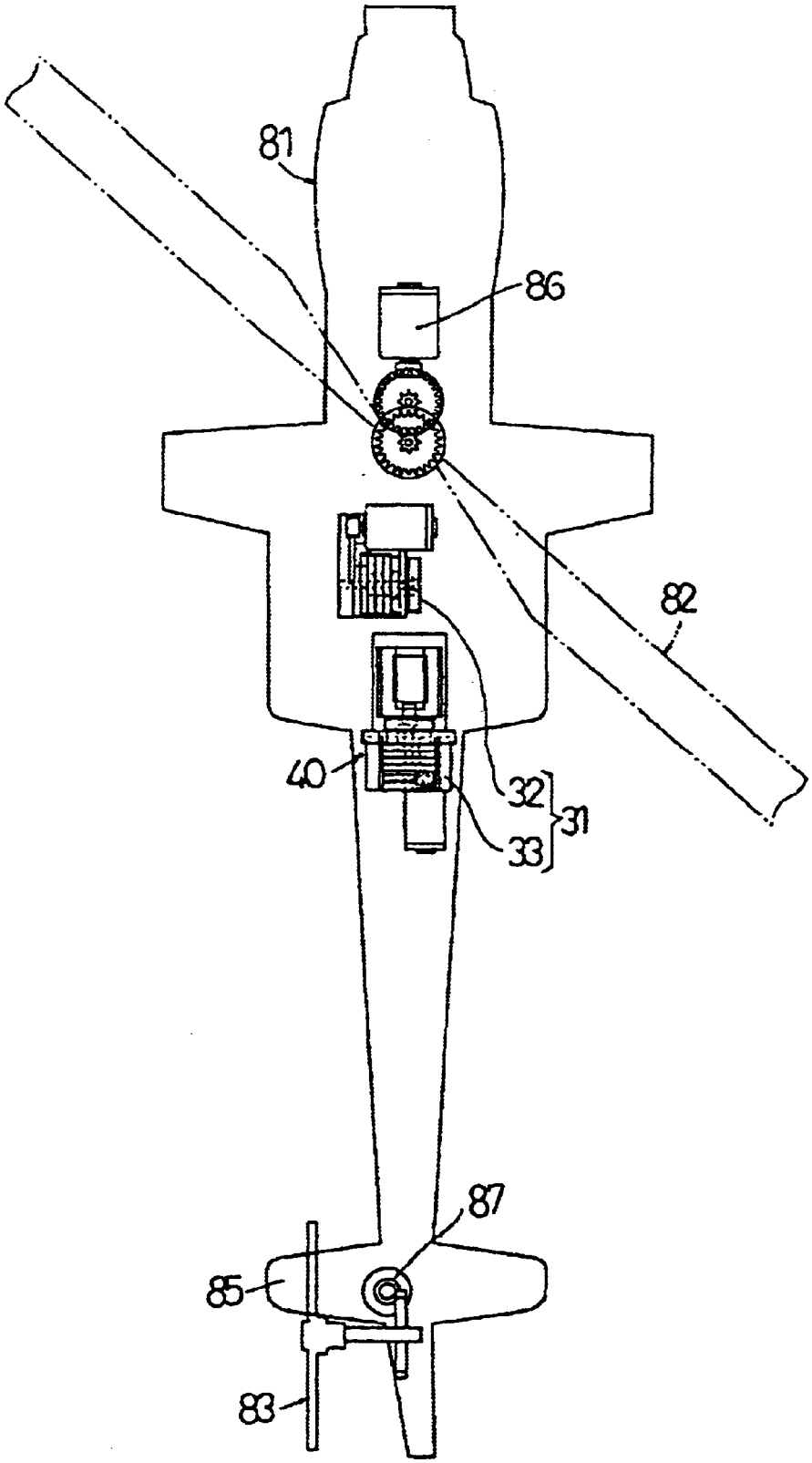
FIG. 13 is an explanatory plan view showing the model aircraft according to Embodiment 2.
Figure 14:
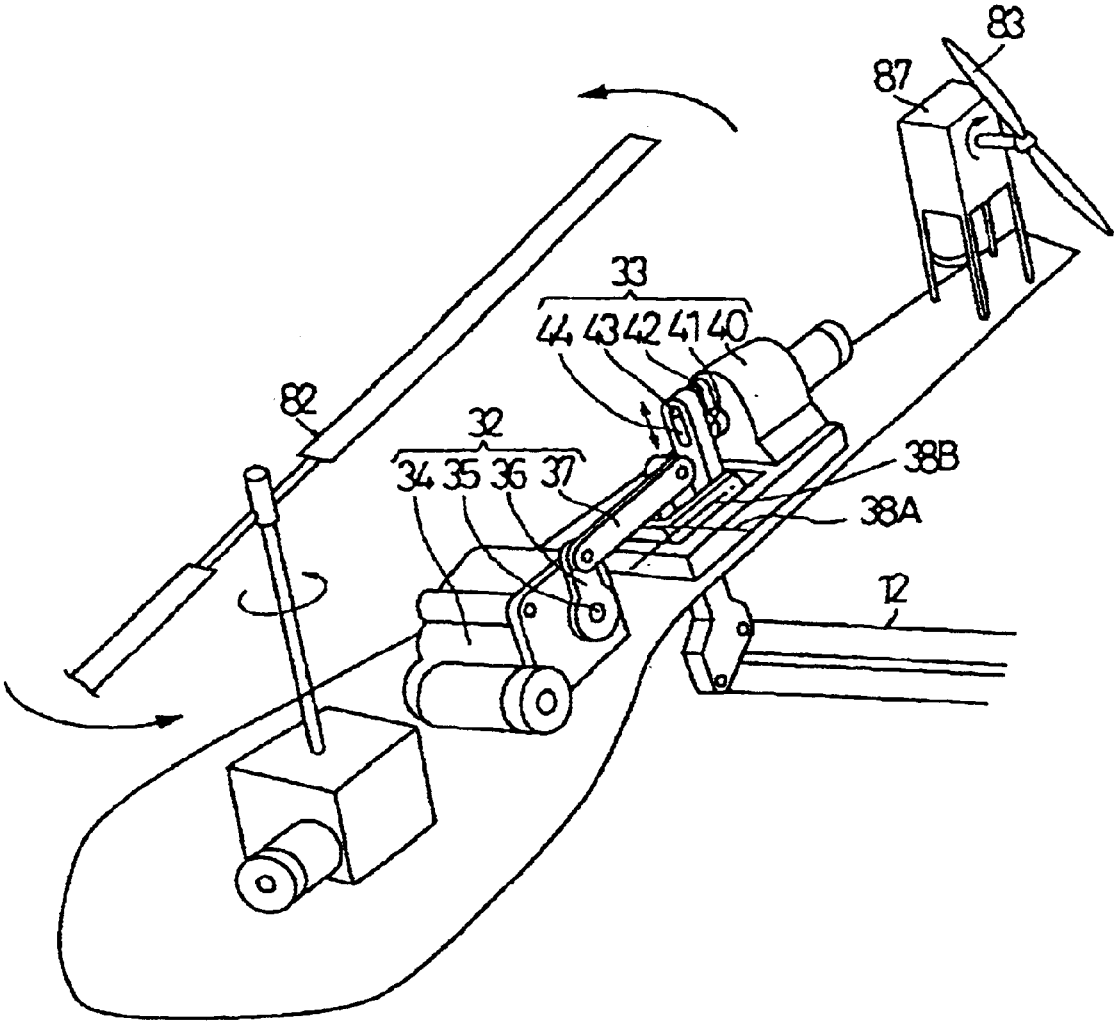
FIG. 14 is an explanatory perspective view showing operation mechanisms mounted in the aircraft of Embodiment 2.

In Embodiment 2, the present invention is applied to a helicopter. As illustrated in FIGS. 12 to 14, the aircraft body 11 in Embodiment 1 is converted into an aircraft body 81 of a helicopter. Accordingly, the aircraft 81 is equipped with a main rotor 82 and a tail rotor 83 in place of the propeller but need not retract a landing gear 84. A tail stabilizer 85 may be movable so as to operate in response to or independently of a change in attitude of the aircraft. The construction of Embodiment 2, shown in FIGS. 12 to 14, is basically similar to that of Embodiment 1. Thus, similar parts are denoted by the same reference numerals as those in Embodiment 1, and the detailed description thereof is omitted. Besides these parts, reference numeral 86 denotes a source of motion used to rotate the main rotor, 87 is a source of motion used to rotate the tail rotor, and 88 is a stabilizer driving system.

The operation of ascending or descending the aircraft body 81 of the helicopter, causing the aircraft body 81 to assume a forward or backward inclined attitude, and turning the aircraft body 81 rightward or leftward is exactly the same as those in Embodiment 1. In this case, the aircraft body 81 can take off substantially perpendicularly to the ground and land on the ground substantially perpendicularly thereto. Further, rotation of the main and tail rotors 82 and 83 and making of the roar of the engine concurrently with rotation of the rotor can be carried out in the same manner as in Embodiment 1. Additionally, the aircraft body 81 is also equipped with a lighting device 48 that is lighted when the controller 65 turns on the main power supply.

Thus, in this invention, the attitude control means is provided at the tip portion of the vertical motion means, thereby producing effects not expected of conventional model aircraft; that is, it is possible to faithfully reproduce the flight attitude of the corresponding real aircraft and the motions associated with flight. In particular, a scale model properly copying the characteristics of corresponding real aircraft can be provided with motions similar to those of corresponding real aircraft, thereby allowing the user to enjoy a sense of piloting or operation as in the case with a simulator.

What is claimed is:

1. A flight control system capable of reproducing a flight attitude of a corresponding real aircraft, the flight control system comprising a base, a model aircraft, a vertical motion means mounted on the base for enabling the model aircraft to ascend or descend in order to reproduce changes in position from a state in which the aircraft is set at a lower position so as to copy the attitude of the corresponding real aircraft during a halt to a state in which the aircraft is set at a higher position so as to copy the attitude of the corresponding real aircraft during flight, an attitude control means mounted in the model aircraft for enabling the model aircraft to be inclined in longitudinal and lateral directions in order to reproduce longitudinal and lateral motions of the corresponding real aircraft, the attitude control means being provided at a tip portion of the vertical motion means so that an operation performed by the vertical motion means can be coordinated with an operation performed by the attitude control means, and an external control section being remotely connected to at least one of said vertical motion means and said attitude control means via wired or wireless communication lines.

2. The flight control system capable of reproducing a flight attitude according to claim 1, wherein the vertical motion means includes two ends, one end of the vertical motion means is provided in a support portion, and the tip portion at the other end of the vertical motion means is formed in the aircraft via the attitude control means.

3. The flight control system capable of reproducing a flight attitude according to claim 2, wherein the support portion has a rotating function to make a rotational motion in a turning direction in response to an inclining motion of the aircraft.

4. The flight control system capable of reproducing a flight attitude according to claim 1, wherein the aircraft contains operating elements such as rotating portions such as propellers or rotors; retractable landing gears, or movable wings, and all or some of the operating elements are operative.

5. The flight control system capable of reproducing a flight attitude according to claim 2, wherein the aircraft or the support portion has sound generating means integrated therewith for reproducing a sound made while the corresponding real aircraft is flying.

6. A model system reproducing a flight attitude of a real aircraft, the model system comprising a base, a model aircraft, a vertical motion device interconnecting said base and said model aircraft for enabling the model aircraft to ascend or descend in order to reproduce changes in position from a state in which the aircraft is set at a lower position on said base so as to copy the attitude of the real aircraft during a halt to a state in which the aircraft is set at a higher position so as to copy the attitude of the real aircraft during a flight, said vertical motion device including a lower member connected to the base and an upper member connected to the model aircraft, said upper member and said lower member being pivotally interconnected for movement of the model aircraft from the base to a position above the base, and an attitude control device mounted in the model aircraft for enabling the aircraft to be inclined in longitudinal and lateral directions in order to reproduce longitudinal and lateral motions of the real aircraft, the attitude control device being provided at a tip portion of the upper member of the vertical motion device so that an operation performed by the vertical motion device can be coordinated with an operation performed by the attitude control device.

* * * * *